US010965046B2

(12) United States Patent
Shimada et al.

(10) Patent No.: US 10,965,046 B2
(45) Date of Patent: Mar. 30, 2021

(54) BOARD WITH TERMINAL

(71) Applicants: AutoNetworks Technologies, Ltd., Yokkaichi (JP); Sumitomo Wiring Systems, Ltd., Yokkaichi (JP); SUMITOMO ELECTRIC INDUSTRIES, LTD., Osaka (JP); SUMITOMO ELECTRIC PRINTED CIRCUITS, INC., Koka (JP)

(72) Inventors: Takanobu Shimada, Yokkaichi (JP); Hiroki Hirai, Yokkaichi (JP); Jyunichi Ono, Yokkaichi (JP); Yoshio Oka, Osaka (JP); Yoshifumi Uchita, Koka (JP); Yoshiro Adachi, Koka (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP); Sumitomo Electric Printed Circuits, Inc., Koka (JP)

( * ) Notice: Subject to any disclaimer, the term of this patent is extended or adjusted under 35 U.S.C. 154(b) by 0 days.

(21) Appl. No.: 16/630,067

(22) PCT Filed: Jun. 28, 2018

(86) PCT No.: PCT/JP2018/024519
§ 371 (c)(1),
(2) Date: Jan. 10, 2020

(87) PCT Pub. No.: WO2019/013000
PCT Pub. Date: Jan. 17, 2019

(65) Prior Publication Data

US 2020/0366009 A1 Nov. 19, 2020

(30) Foreign Application Priority Data

Jul. 13, 2017 (JP) ..... JP2017-137177

(51) Int. Cl.
*H01R 12/58* (2011.01)
*H01R 12/65* (2011.01)
*H01R 13/10* (2006.01)

(52) U.S. Cl.
CPC ..... *H01R 12/58* (2013.01); *H01R 12/65* (2013.01); *H01R 13/10* (2013.01)

(58) Field of Classification Search
CPC ..... H01R 12/58; H01R 12/65; H01R 13/20
See application file for complete search history.

(56) References Cited

U.S. PATENT DOCUMENTS 5,945,727 A * 8/1999 Ishiwa ..... H01R 43/16 257/666
6,102,712 A 8/2000 Nishimura
(Continued)

FOREIGN PATENT DOCUMENTS

CN 103314484 9/2013
JP 9-115574 5/1997
(Continued)

OTHER PUBLICATIONS

International Search Report dated Sep. 18, 2018.

*Primary Examiner* — Briggitte R. Hammond
(74) *Attorney, Agent, or Firm* — Gerald E. Hespos; Michael J. Porco; Matthew T. Hespos

(57) ABSTRACT

A terminal 20 includes a terminal connection portion 21 connected to a counterpart terminal and a board connection portion 24 connected to a conductive path 13 of a board 11. The board connection portion 24 has a plate shape portion 25 that is a plate shape. The plate shape portion is disposed behind the terminal connection portion 21 and is soldered to the conductive path 13 of the board 11. The board connection portion has a plate-shape first projection walls 28A to 28D that are bent from edge portions of a lateral direction side of the plate shape portion 25 and that project to an
(Continued)

opposite side to the board 11 side. The plate shape portion 25 and the first projection walls 28A to 28D have a plating layer 37 that is formed on a plate surface of the plate shape portion and the first projection walls.

11 Claims, 9 Drawing Sheets

(56) References Cited

U.S. PATENT DOCUMENTS

| | | | | |
|---|---|---|---|---|
| 6,764,339 | B2 | 7/2004 | Kubo | |
| 8,636,523 | B2 * | 1/2014 | Nagasaki | H01R 4/26 439/83 |
| 9,136,635 | B2 * | 9/2015 | Muro | H01R 13/514 |
| 9,160,087 | B2 | 10/2015 | Yamanaka et al. | |
| 9,306,301 | B2 * | 4/2016 | Shimoji | H01R 12/75 |
| 9,545,001 | B2 | 1/2017 | Goto | |
| 10,224,649 | B2 * | 3/2019 | Urano | H01R 4/4818 |
| 2003/0119346 | A1 | 6/2003 | Kubo | |
| 2006/0189174 | A1 * | 8/2006 | Fabian | H01R 12/515 439/66 |
| 2013/0170163 | A1 | 7/2013 | Fakhri | |
| 2013/0260579 | A1 | 10/2013 | Yamanaka et al. | |
| 2016/0143138 | A1 | 5/2016 | Goto | |

FOREIGN PATENT DOCUMENTS

| | | |
|---|---|---|
| JP | 11-121114 | 4/1999 |
| JP | 2913359 | 6/1999 |
| JP | 2001-319715 | 11/2001 |
| JP | 2003-187916 | 7/2003 |
| JP | 2007-087930 | 4/2007 |
| JP | 2008-112581 | 5/2008 |
| JP | 2010-251135 | 11/2010 |
| JP | 2013-534032 | 8/2013 |
| JP | 2015-118872 | 6/2015 |
| JP | 2016-096021 | 5/2016 |

* cited by examiner

BOARD WITH TERMINAL

BACKGROUND

Field of the Invention

In the present description, a technology relating to a board with a terminal is disclosed.

Related Art

A conventional technology in which a terminal is soldered to a conductive path of a board is known. In Japanese Unexamined Patent Application Publication No. H11-121114, a connector in which a plurality of plug terminals are fixed to a plug insulator is described, and the plurality of plug terminals extended from a back surface of the plug insulator have tip portions that are offset bent. The tip portions are respectively soldered to connection electrodes on a surface of a circuit board.

A terminal soldered to a board is typically formed by plating a metal plate material and then punching it with a press machine. Therefore, as shown in FIG. 9, although plating layers 2A, 2B are respectively formed on upper and lower plate surfaces of a terminal 1, no plating layer is formed on left and right sides of the terminal 1 that become cut end surfaces 3A, 3B with the press machine. When the terminal 1 is soldered to copper foil 6 superimposed on a board 4 via an adhesive 8, the lower surface of the terminal 1 on which a plating layer 2B is formed and the copper foil 6 are allowed to be soldered. On the other hand, since solder 7 does not spread on the left and right cut end surfaces 3A, 3B of the terminal 1 on which no plating layer is formed, it is concerned that soldering strength may be reduced.

A technology described in the present description has been completed based on the above-described circumstances, and an object of the technology is to suppress a decrease in soldering strength with respect to a terminal soldered to a board.

SUMMARY

A terminal described in the present description is a terminal including a terminal connection portion connected to a counterpart terminal and a board connection portion connected to a conductive path of a board. The board connection portion has a plate shape portion that is a plate shape. The plate shape portion is disposed behind the terminal connection portion and is soldered to the conductive path of the board. The board connection portion has a plate-shape first projection wall that is bent from an edge portion of a lateral direction side of the plate shape portion and that projects to an opposite side to the board side. The plate shape portion and the first projection wall have a plating layer that is formed on a plate surface of the plate shape portion and the first projection wall.

According to the above configuration, the conductive path of the board is soldered to the plate shape portion, and the first projection wall is bent from the edge portion of the lateral direction side of the plate shape portion and projects to the opposite side to the board. Thus, solder connecting the plate shape portion and the conductive path of the board spreads to a bent portion of a base end side of the first projection wall on which the plating layer is formed. Therefore, soldering strength is suppressed from decreasing comparing with a configuration in which side edge portions of the plate shape portion are cut end surfaces.

The following aspects are preferable as embodiments of a technology described in the present description.

The terminal connection portion has a pair of side walls that extend in a direction intersecting with the plate surface of the plate shape portion and that are arranged to be opposite to each other. The terminal connection portion is configured such that the counterpart terminal is inserted between the pair of side walls. The first projection wall may have an outer surface that is disposed on the same plane as an outer surface of either of the side walls or on an inside of the same plane.

In this way, for example, when the terminal is inserted into a cavity of a connector housing, the first projection wall is unlikely to obstruct the insertion. Therefore, the terminal is easily inserted into the cavity of the connector housing.

The terminal connection portion has a pair of opposing walls that extend along the plate surface of the plate shape portion and that are arranged to be opposite to each other. The terminal connection portion is configured such that the counterpart terminal is inserted between the pair of opposing walls. The first projection wall may have a projection dimension being set to a dimension that does not project outward from an outer surface of each of the opposing walls.

In this way, since the first projection wall is unlikely to obstruct the insertion when the terminal is inserted into the cavity of the connector housing, the terminal is easily inserted into the cavity of the connector housing.

A plurality of the first projection walls may be provided in a front-rear direction.

In this way, a crack generated on a soldered portion is suppressed from reaching over the whole.

A pair of the first projection walls may be provided on left and right edge portions of the plate shape portion.

The terminal may include a second projection wall that is bent from the edge portion of the lateral direction side of the plate shape portion and that projects to the board side.

In this way, by engagement of the second projection wall with the board, a stress generated on the soldered portion is reduced when a force is applied to the terminal against the board.

The second projection wall may be disposed on a rear side of the first projection wall.

In this way, an obstacle is suppressed from generating in the solder on a rear side of the first projection wall on which the stress is apt to be generated.

A board with a terminal may include the terminal and the board.

In the board with a terminal, the terminal may have a second projection wall that is bent from an edge portion of a lateral direction side of the plate shape portion and that projects to the board side, and the board may have an insertion recess through which the second projection wall is inserted.

In this way, the terminal is positioned with respect to the board by inserting the second projection wall through the insertion recess, and when the terminal is pulled to the rear side with respect to the board, the second projection wall is engaged with the insertion recess, so that the stress generated on the soldered portion is reduced.

According to the technology described in the present description, soldering strength is suppressed from decreasing with respect to a terminal soldered to a board.

DETAILED DESCRIPTION

First Embodiment

First embodiment will be described with reference to FIG. 1 to FIG. 7. In the following description, it is assumed that X direction in FIG. 3 is the front, Y direction is the left, and Z direction is the upper.

(Board with Terminal 10)

Figure 1:
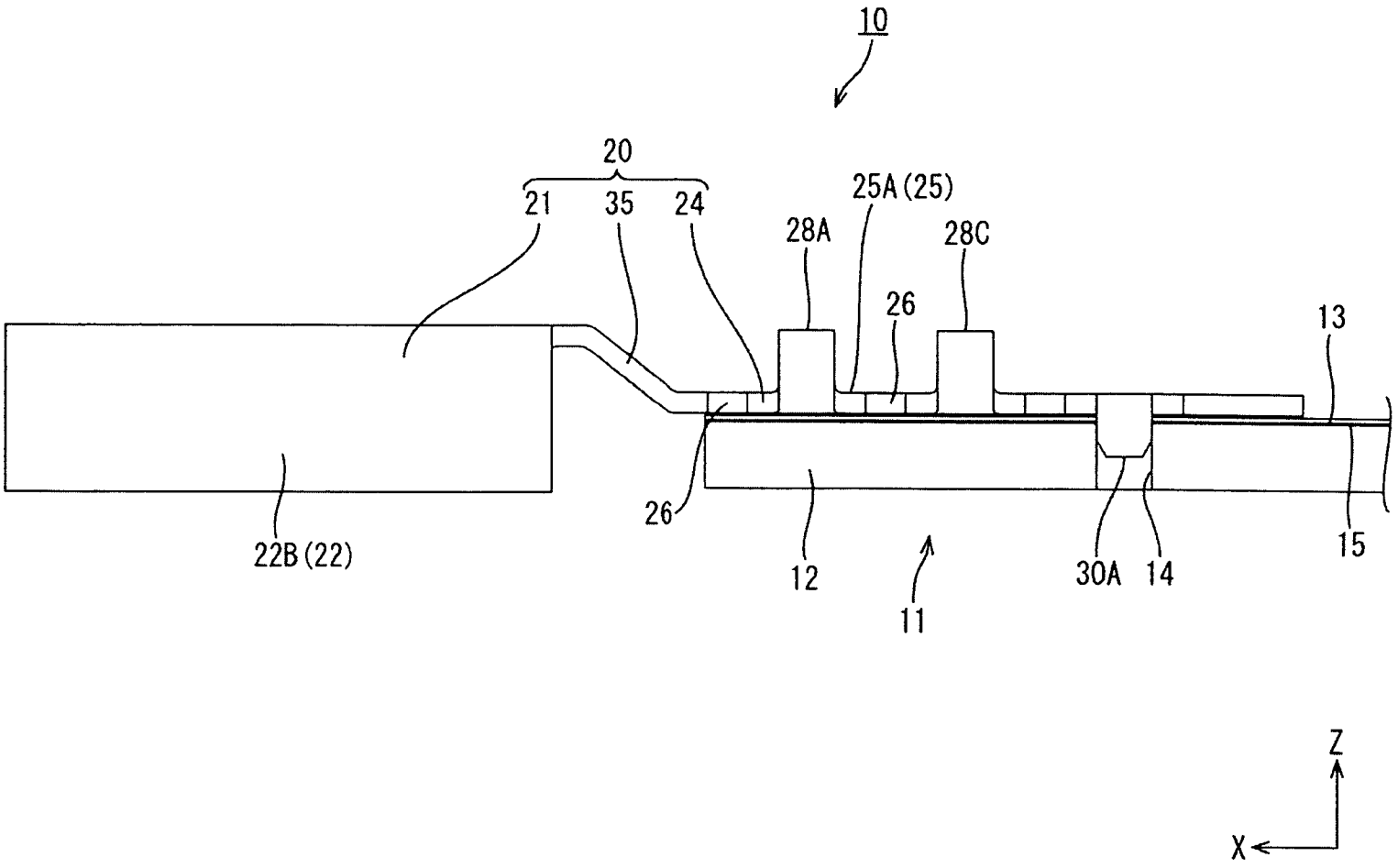
FIG. 1 is a side view illustrating a board with a terminal according to first embodiment.

A board with a terminal 10 is mounted on a vehicle such as an automobile, for example, and includes a board 11 and a terminal 20 to be soldered to the board 11 as shown in FIG. 1.

(Board 11)

Figure 2:
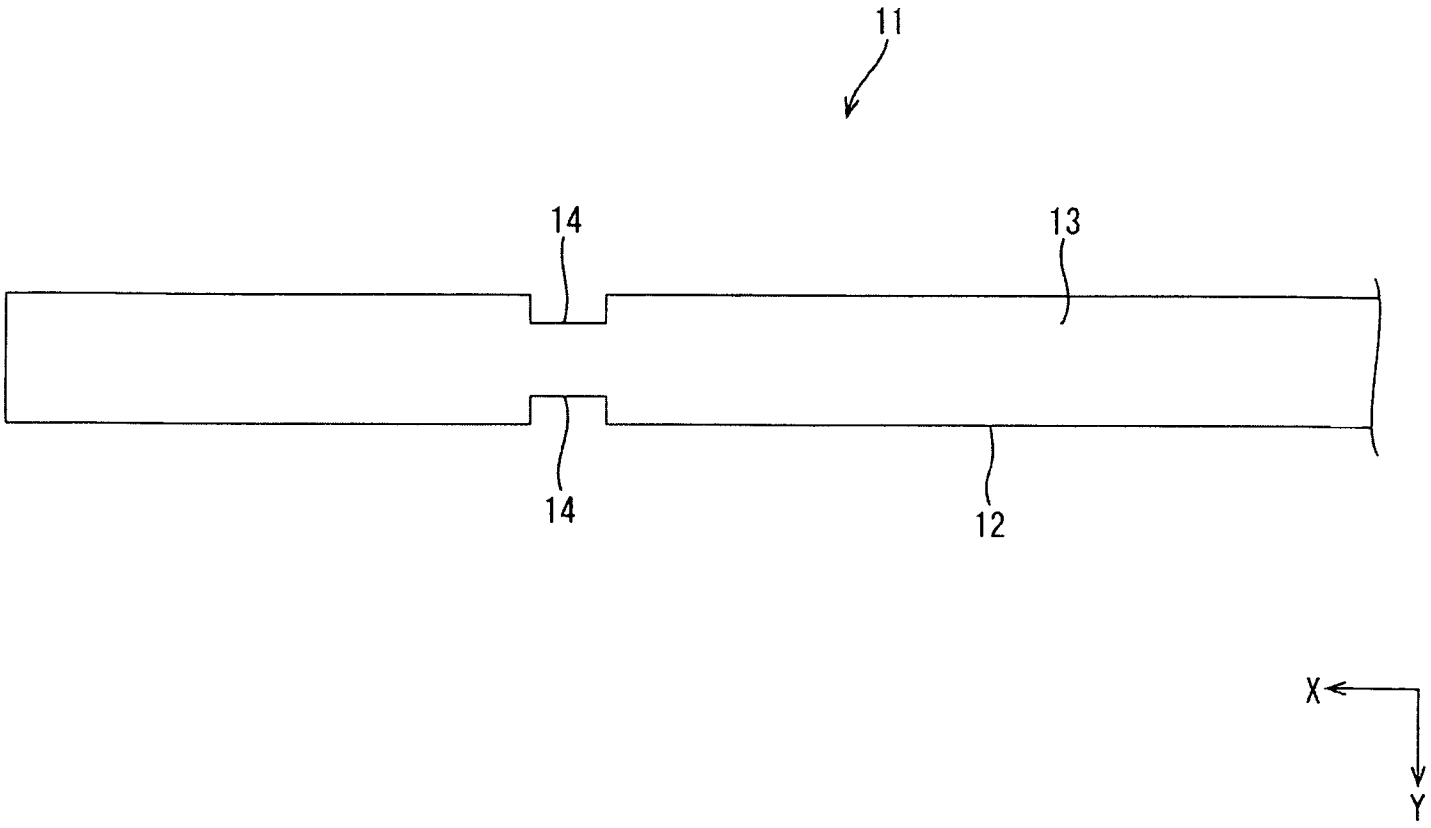
FIG. 2 is a plan view illustrating a board.
Figure 3:
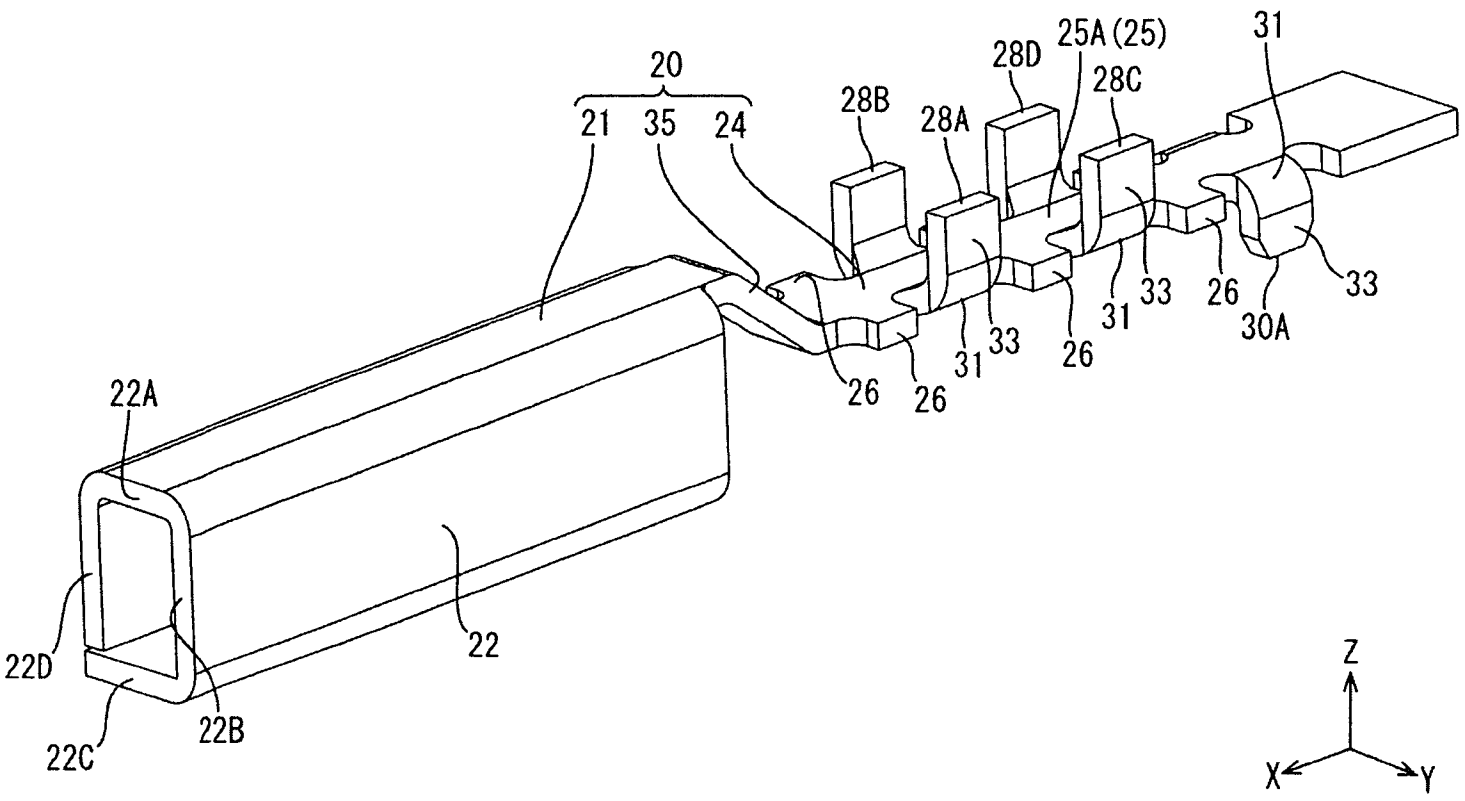
FIG. 3 is a perspective view illustrating a terminal.

As shown in FIG. 1, FIG. 2, the board 11 has a conductive path 13 made of copper foil or the like formed on an insulation plate 12 via an adhesive layer 15, and has a plate shape that is long in a front-rear direction. As the board 11, for example, a flexible printed circuit board (FPC) having flexibility that is bendable and deformable, or a rigid board having no flexibility is allowed to be used. In the present embodiment, although the conductive path 13 is formed only on an upper surface of the insulation plate 12, the present invention is not limited to the above structure. The conductive paths may be formed on both the upper surface and a lower surface of the insulation plate 12, or a multilayer board having multi-layer conductive path may be used. A rear side of the board 11 is connectable to an outside via, for example, an electric wire. Insertion recesses 14 each of which is cut out in a rectangular shape are formed on left and right side edge portions of the board 11. Second projection walls 30A, 30B of the terminal 20 described later are inserted through the insertion recesses 14.

(Terminal 20)

Figure 4:
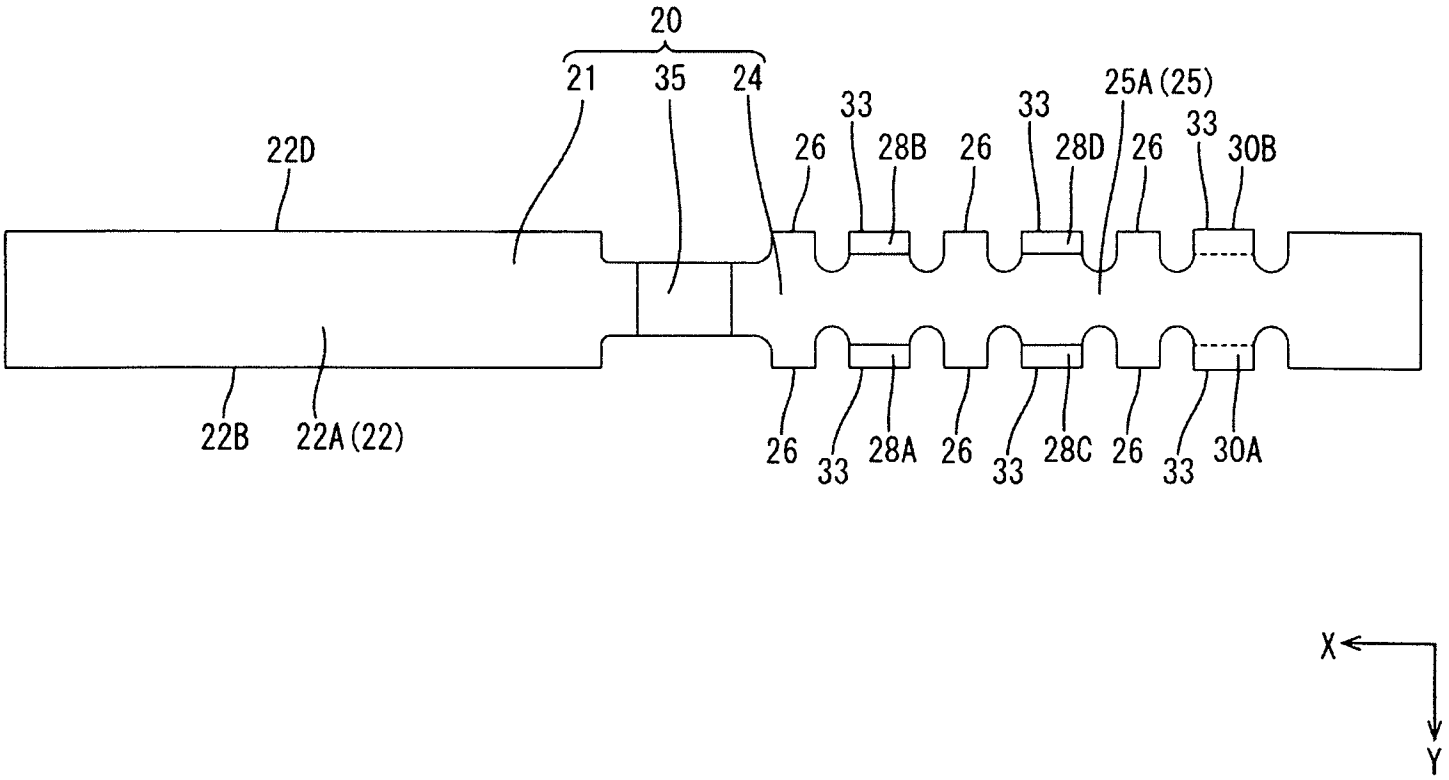
FIG. 4 is a plan view illustrating the terminal.

The terminal 20 is made of, for example, a metal such as copper, copper alloy, aluminum, aluminum alloy, and is a female type as shown in FIG. 3, FIG. 4. The terminal has a terminal connection portion 21 that is connected to a male terminal (counterpart terminal) not shown, a board connection portion 24 that is connected to the conductive path 13 of the board 11, and a connection portion 35 that connects the terminal connection portion 21 and the board connection portion 24.

The terminal connection portion 21 has a rectangular tube-shaped square tube portion 22 into which the male terminal is inserted and an elastic contact piece (not shown) that extends inward from an inner wall of the square tube portion 22 and that comes into contact with the male terminal. The square tube portion 22 is formed by annularly linking a pair of upper and lower opposing walls 22A, 22C opposite to each other and a pair of left and right side walls 22B, 22D connecting between the pair of opposing walls 22A, 22C.

The board connection portion 24 includes a plate shape portion 25 that is a flat plate shape and a plurality of projection walls 28A to 28D, 30A, 30B protruding vertically from edge portions of the plate shape portion 25. The plate shape portion 25 has a belt shape portion 25A extending in a belt shape in the front-rear direction with a predetermined width dimension, and a plurality of extension pieces 26 extending in a flat plate shape from side edges of the belt shape portion 25A in the same plane of a lateral direction.

The plurality of extension pieces 26 are formed between the projection walls 28A to 28D, 30A, 30B adjacent to each other in the front-rear direction, and a tip of each extension piece 26 in an extension direction is positioned at the substantially same position as an outer side surface of each of the projection walls 28A to 28D, 30A, 30B. The tip of each extension piece 26 may be disposed on an inside of the outer side surface of each of the projection walls 28A to 28D, 30A, 30B. The plurality of projection walls 28A to 28D, 30A, 30B include four (a plurality of) first projection walls 28A to 28D each of which projects upward (opposite side to the board 11 side) and two (a plurality of) second projection walls 30A, 30B each of which projects downward (the board 11 side). The first projection walls 28A, 28B, the first projection walls 28C, 28D, and the second projection walls 30A, 30B are provided in pairs on the left and right, and the pair of left and right projection walls are provided in three sets (multiple sets) side by side in the front and rear. The projection walls 28A to 28D, 30A, 30B project in a flat plate shape in an orthogonal direction (intersecting direction) to the belt shape portion 25A from both side edge portions (edge portions of a lateral direction side) of the belt shape portion 25A via curved bent portions 31. An outer surface of the bent portion 31 is curved in a U shape.

Figure 5:
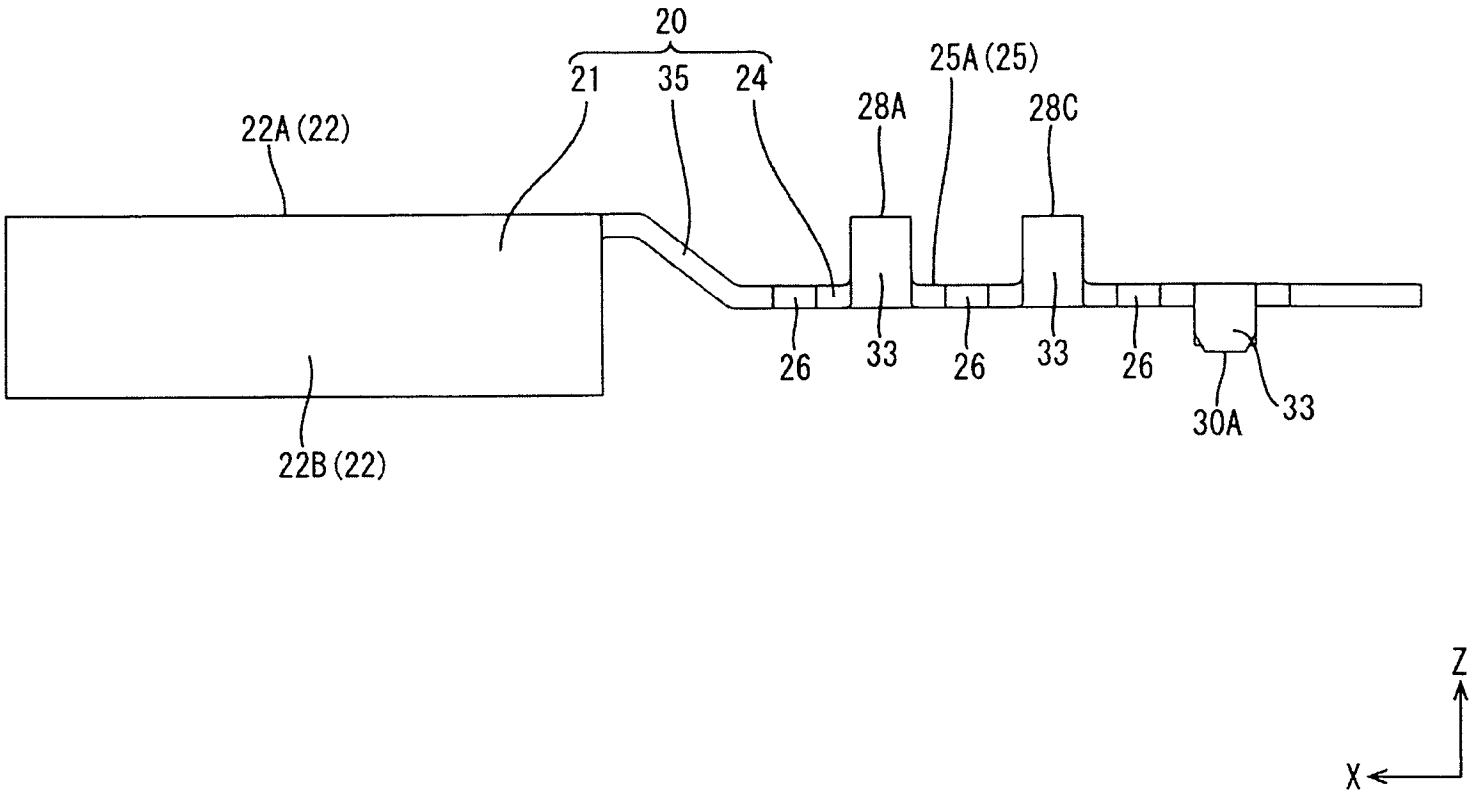
FIG. 5 is a side view illustrating the terminal.

Outer surfaces 33 of the projection walls 28A to 28D, 30A, 30B are disposed on the same plane as outer side surfaces of the side walls 22B, 22D. As another embodiment, the outer surfaces 33 of the projection walls 28A to 28D, 30A, 30B may be disposed on an inside of the outer side surfaces of the side walls 22B, 22D. As shown in FIG. 5, tips of the first projection walls 28A to 28D are disposed on the same plane as an upper surface of the opposing wall 22A of the square tube portion 22. As another embodiment, the tips of the first projection walls 28A to 28D may be disposed on a lower side of the same plane as the upper surface of the opposing wall 22A. The second projection walls 30A, 30B project in an opposite direction to the first projection walls 28A to 28D, and a projection dimension of each of the second projection walls 30A, 30B is smaller than a projection dimension of each of the first projection walls 28A to 28D. Each of corners of tip portions (lower end portions) of the second projection walls 30A, 30B is cut into a tapered shape and formed into a tapering shape.

The connection portion 35 extends in a state of being inclined with respect to the front-rear direction, a front end is connected to the opposing wall 22A of the square tube portion 22, and a rear end is connected to a front end of the plate shape portion 25. Since a position of the plate shape portion 25 is disposed below the opposing wall 22A by the connection portion 35, a space in which the first projection walls 28A to 28D are disposed is secured above the plate shape portion 25 in a cavity 41 of a connector housing 40.

A method of manufacturing the board with a terminal 10 will be described.

After a plating layer 37 made of, for example, tin is formed on an outer surface of a metal plate material, the terminal is formed by performing punching and bending with a press machine (FIG. 3). In this state, although the plating layer 37 is formed on a plate surface of the terminal 20 (refer to FIG. 7), the plating layer 37 is not formed on cut end surfaces (side end surfaces of the plate shape portion 25, the tips of the projection walls 28A to 28D, 30A, 30B, and the like) of the terminal 20 with the press machine, and the metal is exposed.

When solder paste is applied to a lower surface of the plate shape portion 25 or an upper surface of the board 11 and the terminal 20 is superimposed on the board 11, the second projection walls 30A, 30B are inserted through the insertion recesses 14 of the board 11. Then, by reflow soldering the terminal 20 and the board 11, the entire lower surface of the plate shape portion 25 is soldered to the conductive path 13 of the board 11, and the board with a terminal 10 is formed. In this state, the solder S spreads from the plate shape portion 25 to the bent portion 31 on a base end side of each of the first projection walls 28A to 28D, and solder fillets are formed between the bent portions 31 and the conductive path 13 (refer to FIG. 7).

Figure 6:
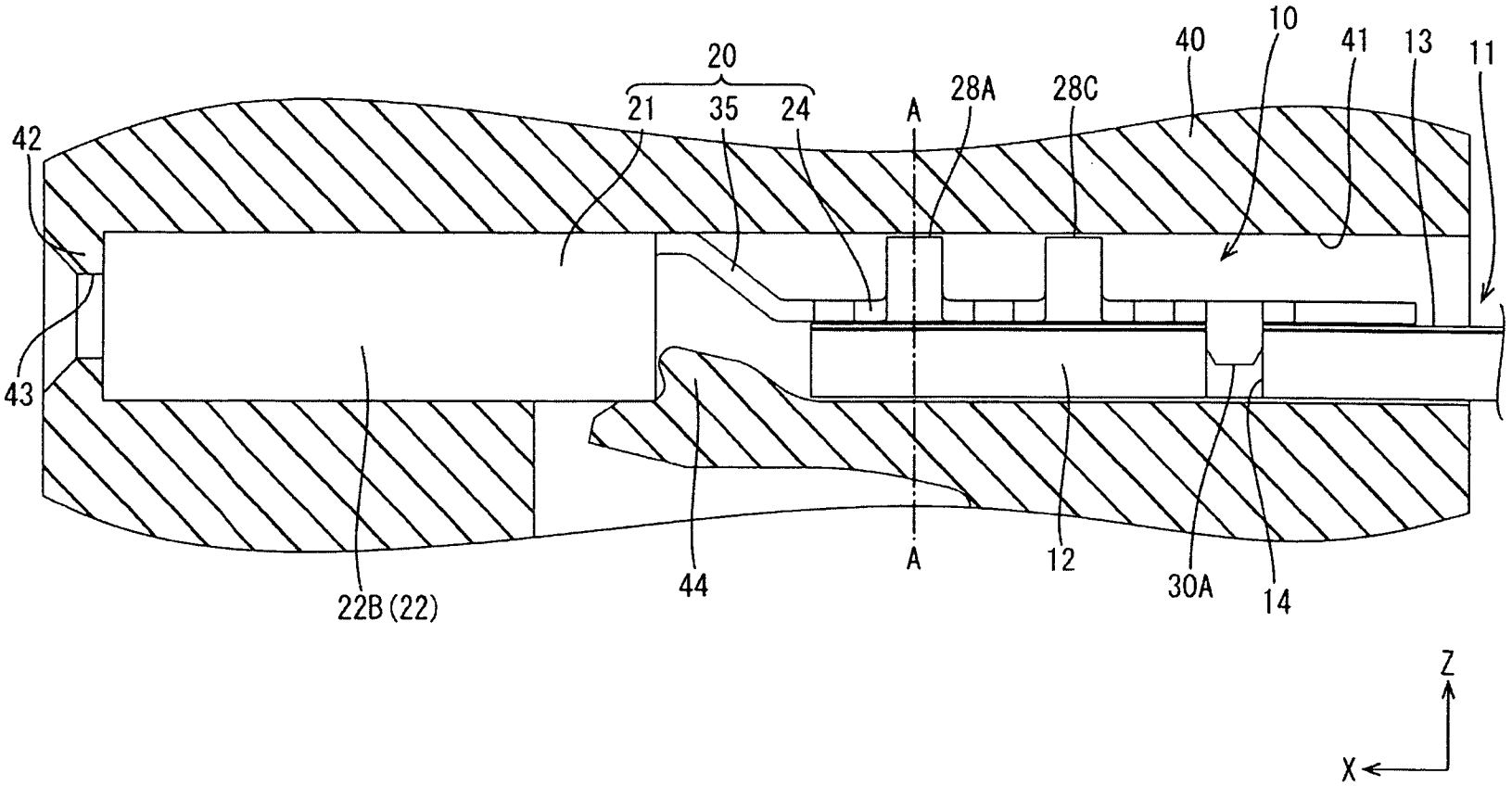
FIG. 6 is a view illustrating the board with a terminal accommodated in a cavity of a connector housing.
Figure 7:
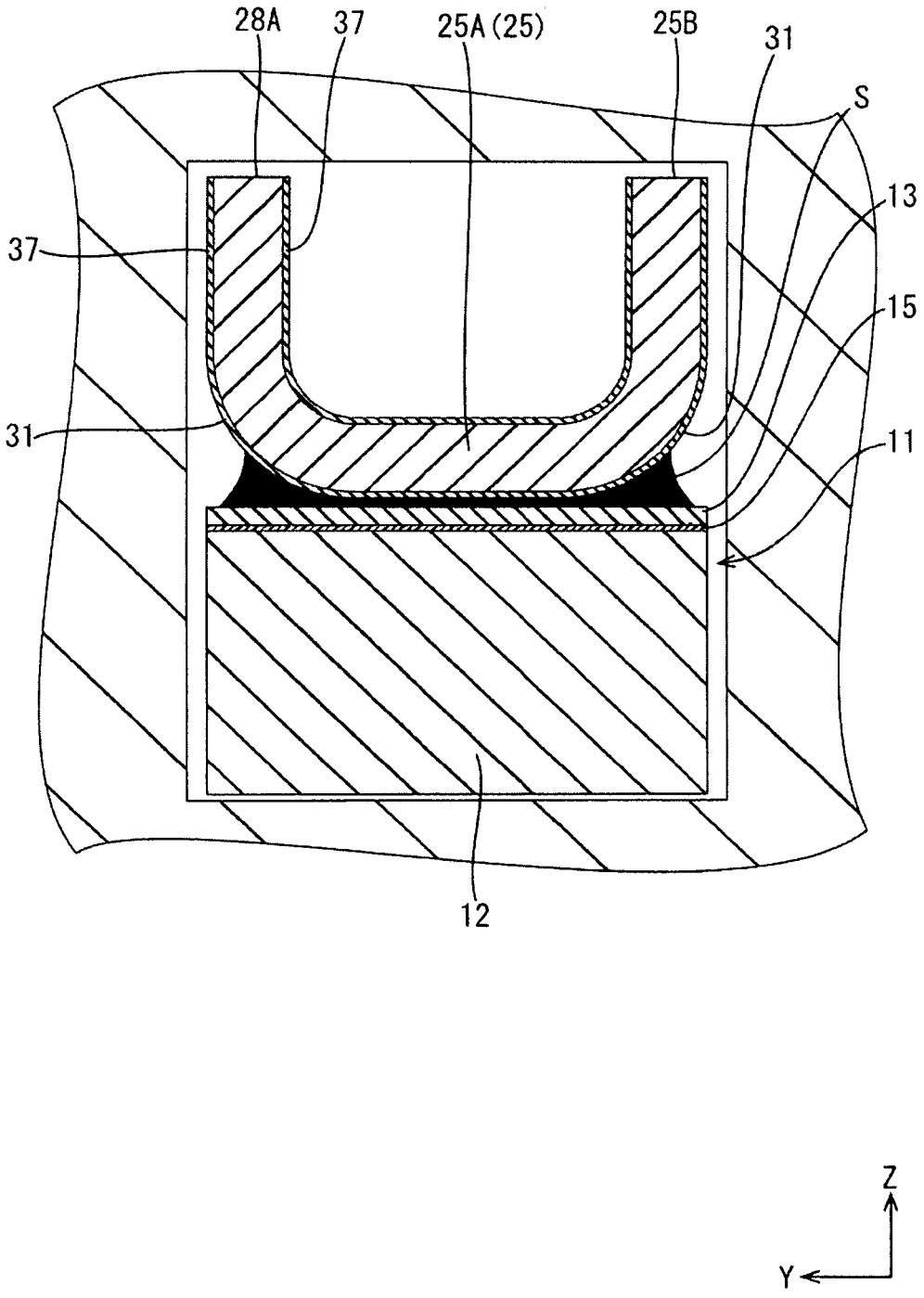
FIG. 7 is a cross-sectional view taken along line A-A in FIG. 6.

As shown in FIG. 6, the board with a terminal 10 is accommodated in the connector housing 40 made of synthetic resin (only a part of the connector housing 40 is shown in FIG. 6). The connector housing 40 is to be fitted with a counterpart connector housing in which the male terminal is accommodated, and has the cavity 41 through which the board with a terminal 10 is inserted. The cavity 41 has a rectangular side cross-section and penetrates the connector housing 40 in the front-rear direction. An annular front stop wall 42 projects inward in a front end portion of the cavity 41, and a lance 44 engaging with a rear end edge of the terminal connection portion 21 to prevent the terminal 20 from being extracted extends from an inner wall of the cavity 41 in a cantilever shape. An inside of the front stop wall 42 is a terminal insertion hole 43 through which the male terminal is inserted.

When the board with a terminal 10 is accommodated in a regular position of the cavity 41, the terminal connection portion 21 is held between the front stop wall 42 and the lance 44, and the entire board connection portion 24 is accommodated in the cavity 41 to be positioned. In FIG. 6, although the rear side of the board 11 is led out from the cavity 41, the entire board 11 may be accommodated in the cavity 41.

According to the present embodiment, the following functions and effects are exerted.

The terminal 20 includes the terminal connection portion 21 connected to the counterpart terminal (male terminal) and the board connection portion 24 connected to the conductive path 13 of the board 11. The board connection portion 24 has the plate shape portion 25 being the plate shape that is disposed behind the terminal connection portion 21 and that is soldered to the conductive path 13 of the board 11. The board connection portion 24 has the plate-shape first projection walls 28A to 28D that are bent from the edge portions of the lateral direction side of the plate shape portion 25 and that projects to the opposite side to the board 11. The plating layers 37 are formed on the plate surfaces of the plate shape portion 25 and the first projection walls 28A to 28D.

According to the present embodiment, the conductive path 13 of the board 11 is soldered to the plate shape portion 25, and the first projection walls 28A to 28D are bent from the edge portions of the lateral direction side of the plate shape portion 25 and project to the opposite side to the board 11. As a result, since the solder S connecting the plate shape portion 25 and the conductive path 13 of the board 11 spreads to the bent portion 31 on the base end side of each of the first projection walls 28A to 28D that has a curved plate surface on which the plating layer 37 is formed, soldering strength is suppressed from decreasing comparing with a configuration in which side edge portions of the plate shape portion 25 are the cut end surfaces.

The terminal connection portion 21 has the pair of side walls 22B, 22D that extend in an orthogonal direction (intersecting direction) to a plate surface of the plate shape portion 25 and arranged to be opposite to each other, and is configured such that the counterpart terminal is inserted between the pair of side walls 22B, 22D. An outer surface of each of the first projection walls 28A to 28D is disposed on the same plane as the outer surface of either of the side walls 22B, 22D or on the inside of the same plane.

In this way, for example, when the terminal is inserted into the cavity 41 of the connector housing 40, the first projection walls 28A to 28D are unlikely to obstruct the insertion. Therefore, the terminal is easily inserted into the cavity 41 of the connector housing 40.

The terminal connection portion 21 has the pair of opposing walls 22A, 22C that extend along the plate surface of the plate shape portion 25 and arranged to be opposite to each other, and is configured such that the counterpart terminal is inserted between the pair of opposing walls 22A, 22C. A projection dimension of each of the first projection walls 28A to 28D is set to a dimension that does not project outward from an outer surface of each of the opposing walls 22A, 22C.

In this way, since the first projection walls 28A to 28D are unlikely to obstruct the insertion when the terminal is inserted into the cavity 41 of the connector housing 40, the terminal is easily inserted into the cavity 41 of the connector housing 40.

The plurality of first projection walls 28A to 28D are provided in the front-rear direction.

In this way, a crack generated on a soldered portion is suppressed from reaching over the whole.

The second projection walls 30A, 30B are disposed on a rear side of the first projection walls 28A to 28D.

In this way, an obstacle is suppressed from generating in the solder on the rear side of the first projection walls 28A to 28D on which a stress is apt to be generated.

The terminal 20 has the second projection walls 30A, 30B that are bent from the edge portions of the lateral direction side of the plate shape portion 25 and that project to the board 11 side. The board 11 has the insertion recesses 14 through which the second projection walls 30A, 30B are inserted.

In this way, the terminal 20 is positioned with respect to the board 11 by inserting the second projection walls 30A, 30B through the insertion recesses 14, and when the terminal 20 is pulled to the rear side with respect to the board 11, the second projection walls 30A, 30B are engaged with the insertion recesses 14, so that the stress generated on the soldered portion is reduced.

Second Embodiment

Figure 8:
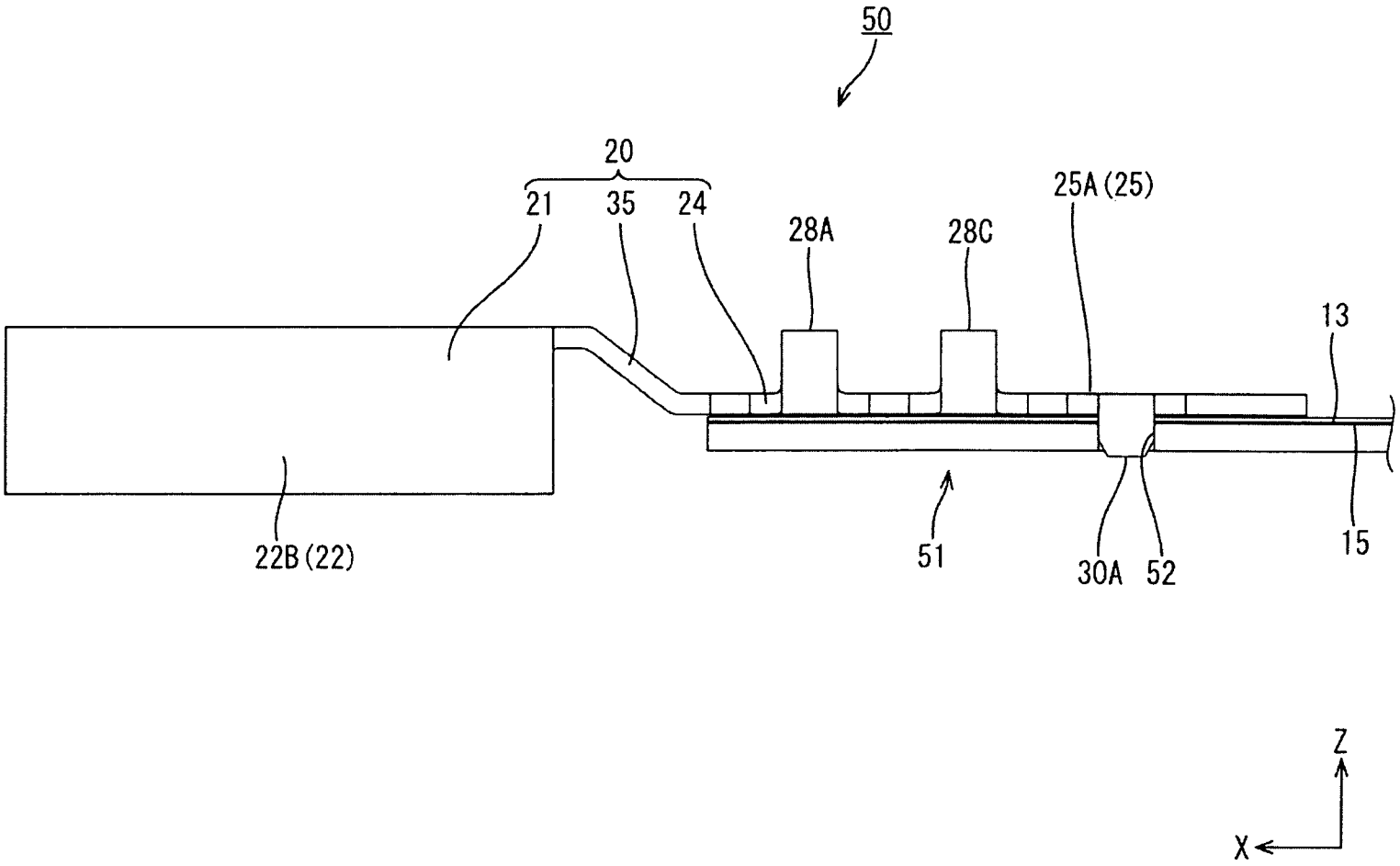
FIG. 8 is a side view illustrating a board with a terminal according to second embodiment.
Figure 9:
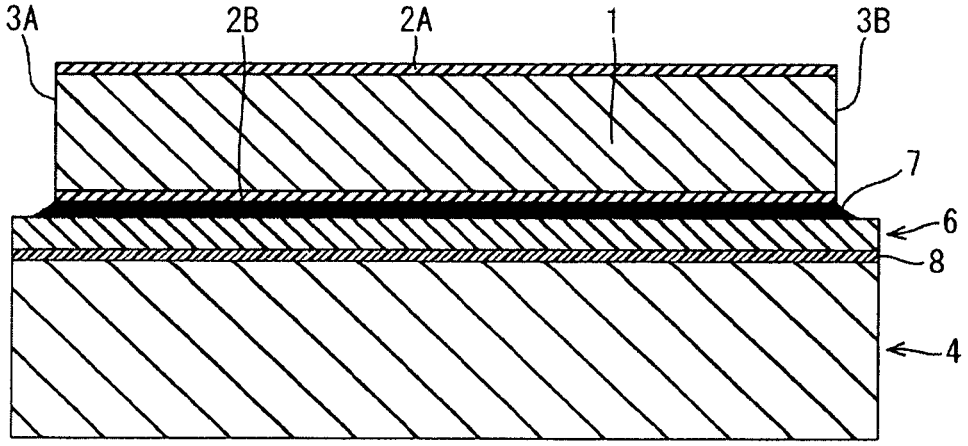
FIG. 9 is a cross-sectional view illustrating a state where a conventional terminal is soldered to a board.

Second embodiment will be described with reference to FIG. 8 hereinafter. Aboard with a terminal 50 of the second embodiment is configured by altering a thickness of the board 11 with respect to the board with a terminal 10 of the first embodiment. Since other configurations are the same as those of the first embodiment, the same configurations as those of the first embodiment are denoted by the same reference symbols and description thereof is omitted.

The board with a terminal 50 includes the terminal 20 and a board 51 to which the terminal 20 is soldered. The board

51 is, for example, the flexible printed circuit board, and has a plate shape that is long in the front-rear direction. The conductive path 13 made of the copper foil or the like is formed on the insulation plate 12 via the adhesive layer 15. Insertion recesses 52 each of which is cut out in the rectangular shape are formed on the side edge portions of the board 11. In the insertion recesses 52, the second projection walls 30A, 30B of the terminal 20 are inserted, and the tips of the second projection walls 30A, 30B penetrate the insertion recesses 52. A rear side of the board is connected to the outside via, for example, the electric wire. A thickness of the board 51 is equal to a thickness of the plate shape portion 25 or slightly thicker than the plate shape portion 25. Although not illustrated, a reinforcement plate may be superimposed on the board 51, and the board 51 may be inserted through the cavity 41 in a state in which the reinforcement plate is superimposed on the board 51.

Other Embodiments

The technology described in the present description is not limited to the embodiments described with reference to the above description and the drawings. For example, the following embodiments are also included in the technical scope of the technology described in the present description.

(1) Although the first projection walls 28A to 28D and the second projection walls 30A, 30B project in the orthogonal direction to the plate surface of the plate shape portion 25, the present invention is not limited to the configuration. For example, they may project in an oblique direction with respect to the plate surface of the plate shape portion 25.

(2) The projection dimensions of the first projection walls 28A to 28D and the second projection walls 30A, 30B are not limited to the dimensions of the above-described embodiments, and may be different projection dimensions. For example, the projection dimensions of the first projection walls 28A to 28D may be reduced, so that at least the solder fillets are formed on the bent portions 31.

(3) The number of the first projection walls 28A to 28D and the second projection walls 30A, 30B is not limited to the number of those of the above embodiments. For example, the number of the first projection walls 28A to 28D and the second projection walls 30A, 30B may be respectively one. Only the first projection walls 28A to 28D may be provided without providing the second projection walls 30A, 30B. The first projection walls may be provided over the entire length in the front-rear direction with respect to the side edge portions of the plate shape portion 25 to be soldered to the boards 11, 51.

EXPLANATION OF SYMBOLS

10, 50: Board with a terminal
11, 51: Board
12: Insulation plate
13: Conductive path
14, 52: Insertion recess
20: Terminal
21: Terminal connection portion
22: Square tube portion
22A, 22C: Opposing wall
22B, 22D: Side wall
24: Board connection portion
25: Plate shape portion
28A to 28D: First projection wall
30A, 30B: Second projection wall
31: Bent portion
40: Connector housing
41: Cavity

The invention claimed is:

1. A board with a terminal to be inserted through a cavity of a connector housing, the board with a terminal comprising:

a terminal including a terminal connection portion connected to a counterpart terminal and a board connection portion connected to a conductive path of a board; and the board, wherein the board connection portion of the terminal has a plate shape portion that is a plate shape, the plate shape portion is disposed behind the terminal connection portion and is soldered to the conductive path of the board, the board connection portion has a plate-shape first projection wall that is bent from an edge portion of a lateral direction side of the plate shape portion and that projects to an opposite side to the board side, the board connection portion has a second projection wall that is bent from the edge portion of the lateral direction side of the plate shape portion and that projects to the board side, the board includes an insertion recess through which the second projection wall is inserted, and the plate shape portion and the first projection wall include a plating layer that is formed on a plate surface of the plate shape portion and the first projection wall, wherein the second projection wall is disposed on a rear side of the first projection wall.

2. The board with a terminal according to claim 1, wherein the terminal connection portion has a pair of side walls that extend in a direction intersecting with the plate surface of the plate shape portion and that are arranged to be opposite to each other, the terminal connection portion is configured such that the counterpart terminal is inserted between the pair of side walls, and the first projection wall has an outer surface that is disposed on the same plane as an outer surface of either of the side walls or on an inside of the same plane.

3. The board with a terminal according to claim 2, wherein the terminal connection portion has a pair of opposing walls that extend along the plate surface of the plate shape portion and that are arranged to be opposite to each other, the terminal connection portion is configured such that the counterpart terminal is inserted between the pair of opposing walls, and the first projection wall has a projection dimension being set to a dimension that does not project outward from an outer surface of each of the opposing walls.

4. The board with a terminal according to claim 3, wherein a plurality of the first projection walls are provided in a front-rear direction.

5. The board with a terminal according to claim 4, wherein a pair of the first projection walls are provided on left and right edge portions of the plate shape portion.

6. The board with a terminal according to claim 5, wherein the second projection wall is disposed on a rear side of the first projection wall.

7. The board with a terminal according to claim 1, wherein the terminal connection portion has a pair of opposing walls that extend along the plate surface of the plate shape portion and that are arranged to be opposite to each other, the terminal connection portion is configured such that the counterpart terminal is inserted between the pair of opposing walls, and the first projection wall has a projection dimension being set to a dimension that does not project outward from an outer surface of each of the opposing walls.

8. The board with a terminal according to claim 1, wherein a plurality of the first projection walls are provided in a front-rear direction.

9. The board with a terminal according to claim 1, wherein a pair of the first projection walls are provided on left and right edge portions of the plate shape portion.

10. A board/terminal assembly to be inserted through a cavity of a connector housing, the board/terminal assembly comprising:

a board having a conductive path and having at least one insertion recess; and a terminal including:

a tubular terminal connection portion having opposed left and right side walls and opposed top and bottom walls extending between the left and right side walls, the tubular terminal connection portion being connectable to a counterpart terminal by having the counterpart terminal inserted between the left and right side walls and between the top and bottom walls, and a board connection portion disposed behind the terminal connection portion and having a plate soldered to the conductive path of the board, opposite left and right first projection walls projecting from opposite left and right lateral sides of the plate at plural positions spaced apart in a front-rear direction, each of the first projection walls being bent to project away from the board, outwardly facing surfaces of the left and right first projection walls are disposed in a common plane with outer surfaces of the left and right side walls of the tubular terminal connection portion or are disposed inward of the outer surfaces of the left and right side walls of the tubular terminal connection portion, and projecting dimensions of the left and right first projection walls are set so that the left and right first projection walls do not project outward beyond the top and bottom walls of the tubular terminal connection portion, the board connection portion further having at least one second projection wall projecting from at least one of the opposite left and right lateral sides of the plate, the at least one second projection wall being bent toward the board and inserted into the at least one insertion recess in the board, and a plating layer formed on plate surfaces of the plate and the first projection wall.

11. The board/terminal assembly of claim 10, wherein the at least one second projection wall is at a position rearward of the first projection walls.

* * * * *